United States Patent [19]

Sato

[11] 4,226,183

[45] Oct. 7, 1980

[54] INK SUPPLY DEVICE FOR LABEL PRINTING MACHINE

[75] Inventor: Yo Sato, Tokyo, Japan

[73] Assignee: Kabushiki Kaisha Sato, Tokyo, Japan

[21] Appl. No.: 939,665

[22] Filed: Sep. 5, 1978

[51] Int. Cl.[2] ..... B41F 1/46; B41F 1/50

[52] U.S. Cl. ..... 101/295; 101/320; 101/314; 101/359

[58] Field of Search ..... 101/288–295, 101/359, 314, 315, 320, 321; 156/384

[56] References Cited

U.S. PATENT DOCUMENTS

| | | | |
|---|---|---|---|
| 312,455 | 2/1885 | Gaiger | 101/320 |
| 408,913 | 8/1889 | Farmer | 101/295 |
| 1,159,037 | 11/1915 | Jacobus | 101/293 |
| 1,314,133 | 8/1919 | Elam | 101/320 |
| 1,398,076 | 11/1921 | Lang et al. | 101/321 |
| 1,441,083 | 1/1923 | Heiner | 101/295 |
| 2,796,827 | 6/1957 | Vantlander | 101/321 |
| 4,057,452 | 11/1977 | Sato | 101/288 |
| 4,073,234 | 2/1978 | Sato | 101/292 |
| 4,113,544 | 9/1978 | Sato | 101/292 |

FOREIGN PATENT DOCUMENTS

| | | | |
|---|---|---|---|
| 1436044 | 10/1968 | Fed. Rep. of Germany | 101/292 |

*Primary Examiner*—William Pieprz

*Attorney, Agent, or Firm*—Ostrolenk, Faber, Gerb & Soffen

[57] ABSTRACT

An ink supply device for use with a desk type label printing or tagging machine: The machine includes a printing head that is movable up and down for printing the labels of a continuous strip. The ink supply device includes an ink roller for rolling over the type surfaces and an ink roller holding mechanism. A link mechanism is provided for moving the printing head up and down as the ink roller holding mechanism moves back and forth over the types. A guide mechanism, attached in a rocking manner to the printing head, guides the ink roller holding mechanism so that the ink roller applies a preset, constant pressure upon the type surfaces of the printing head. The guide mechanism includes two pairs of guide rollers, which are rotatably attached to both sides of the ink roller holding mechanism, and includes a pair of guide links formed with a pair of guide slots that receive the guide rollers and which are sized and positioned to regulate the spacing during the ink supply operation between the axis of the ink roller and the type surfaces. The guide links are supported by rocking links that define a parallelogram with the guide links.

6 Claims, 5 Drawing Figures

INK SUPPLY DEVICE FOR LABEL PRINTING MACHINE

BACKGROUND OF THE INVENTION

1. Field of the Invention

The present invention relates to a label printing machine, and more particularly to an ink supply device for the printing head of a label printing machine.

2. Description of the Prior Art

A conventional tagging or label printing machine of the desk type has an ink supply device comprising an ink roller that is attached rotatably to the leading ends of of spring-biased pivotable arms, so that the surface of the ink roller is depressed as it rolls over the type surfaces of the printing head in accordance with the pivot positions of the arms, thereby to supply the type surfaces with ink.

However, such a conventional ink supply device has several disadvantages.

The ink roller is urged into contact with the type surfaces by a spring. The pressure of the ink roller upon the type surfaces will gradually decrease as the biasing force of the spring is weakened due to its aging. Ink application gradually diminishes so that the imprints upon the label surfaces become unclear.

Even those labels which are not clearly printed by conventional label printing machines are still accepted for use as price-indicating labels so long as they can be read by the naked eye when a customer purchases a commodity or when a clerk of a store totals the sale. During this decade, however, the so-called "POS (Point-of-Sale) System" has been put into practice worldwide. In this system, machine readable bar codes or OCR characters are printed on tags or labels are are automatically read out by an optical reader that is connected to an electronic computer. These readers are used in place of the register clerk for reading the labels on the commodities. These readers permit the materials for management, such as stock, sale, market research and profit counting, to be stored for subsequent processing by the computer. For such a system, precision in the imprints upon the labels, or the like, is required.

Moreover, as the biasing force of the spring that presses an inking roller against the type surfaces is gradually weakened, the ink roller is less depressed by the types of the printing head and the ink stored at the center of the ink roller fails to ooze out. As a result, ink impregnated in the ink roller that is not in the vicinity of the periphery of the ink roller will not be squeezed from the ink roller. This reduces the number of labels that can be printed by a single ink roller, thus rendering conventional ink supply devices uneconomical.

Still further, in a conventional desk type label printing or tagging machine, the rotating arms for holding the ink rollers, as well as the cover of the machine, protrude considerably from the side of the body of the machine because the rotating arms normally rotate sideways of the body so as to apply ink to the type surfaces. The protrusions will often hinder the label printing and/or applying operations, with resultant deterioration in design.

SUMMARY OF THE INVENTION

It is, therefore, an object of the present invention to provide an ink supply device for use with a label printing machine, or the like, which is free from the drawbacks concomitant with the prior art.

Another object of the present invention is to provide an ink supply device of the above type, in which ink rollers always turn under a preset, constant pressure over the type surfaces of a printing head, as the rollers move back and forth through the body of the label printing machine.

Still another object of the invention is to provide an ink supply device of the above type, in which the supply of ink to the type surfaces can be maintained at a level to always print the tags or labels clearly.

A further object of the invention is to provide an ink supply device of the above type, in which all of the ink in an ink impregnated ink roller can be consumed without waste by ensuring the oozing of the ink at the vicinity of the periphery and also the ink stored deep in the center portion of the ink rollers.

A further object is to provide an ink supply device of the above type, in which side protrusions from the body of the machine are eliminated to smooth the label printing and applying operations and to give the machine excellent design.

The present invention concerns an ink supply device for use with a label printing machine, wherein the machine includes a printing head having type surfaces that are movable up and down for printing the types upon a label. The ink supply device comprises an ink roller adapted to roll over the type surfaces of the printing head for applying ink thereto. An ink roller holding mechanism holds the ink roller so that it may rotate. There are means for moving the printing head up and down and for moving the ink roller holding mechanism forward and back of the body of the label printing machine so as to apply ink to the moving types on the printing head.

A guide mechanism attached in a rocking manner to the printing head includes means for guiding the ink roller holding mechanism such that the ink roller applies a predetermined pressure upon the type surfaces of said printing head as it rolls over the type surfaces.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENT

The present invention is now described in conjunction with one embodiment thereof with reference to the accompanying drawings.

Figure 1:
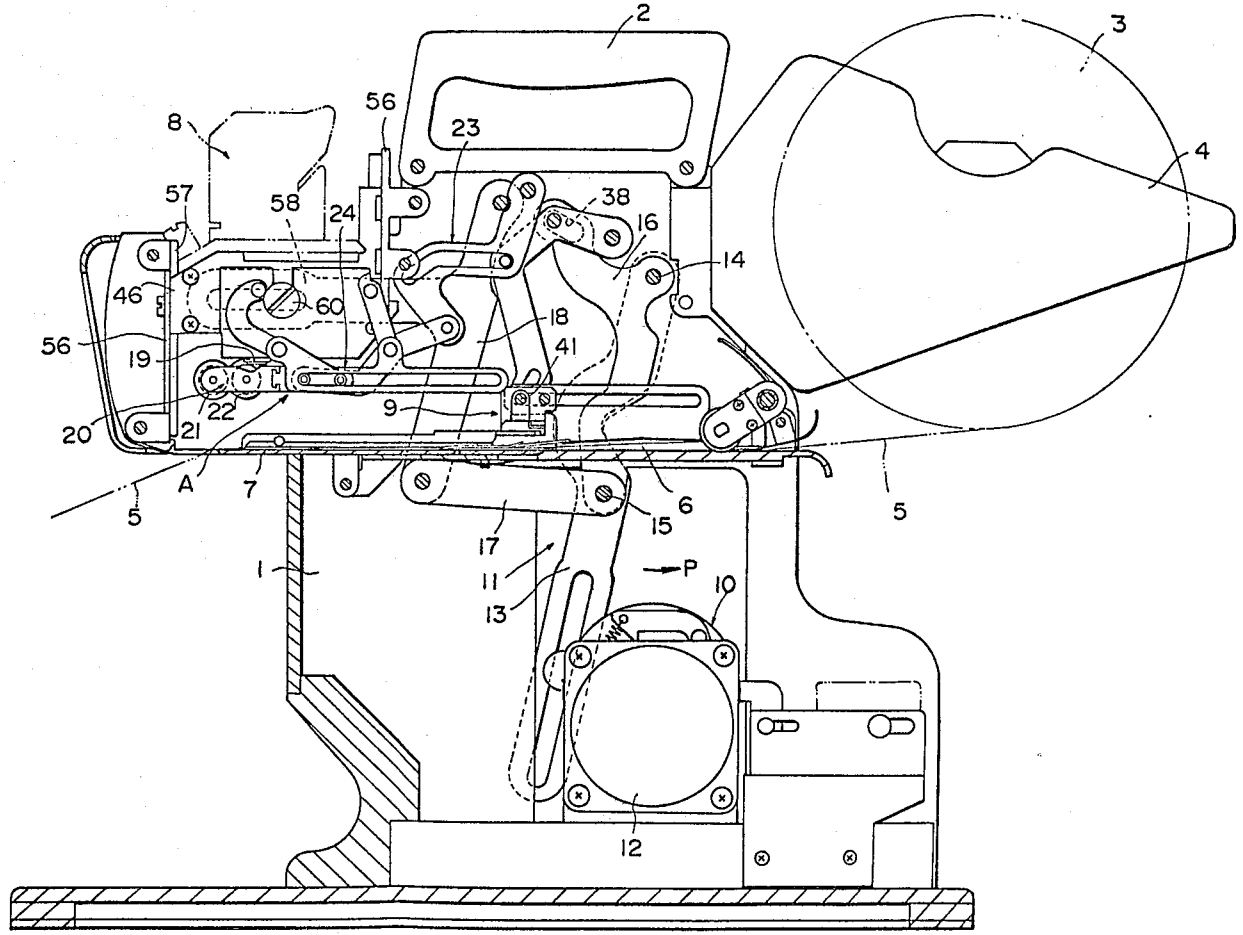
FIG. 1 is a side elevational view showing a label printing machine including the ink supply device of the invention, with the frame on the viewing side removed.

An ink supply device A is used with a desk type label printing machine, of the electrically operated type. Referring to FIG. 1, the frames 1 of the label printing machine have upper portions which are integral with a grip 2 and have rear (right in FIG. 1) portions which are integral with a label strip holder 4, on which a continuous strip of labels 3 is rolled. The machine frames 1 have a label transfer path 6 formed at their center portion which extends in the longitudinal direction to allow an unrolled label strip 5 to pass through to the front of the machine. A printing head 8, the ink supply device A and a label feeding mechanism 9 are arranged above the label transfer path 6.

A drive mechanism 10 is also arranged below the label transfer path 6. The driving force of the drive mechanism 10 is transmitted through a force transmission mechanism 11 to the ink supply device A, the printing head 8 and the label feeding mechanism 9. The drive mechanism comprises a drive motor 12, which, when energized, turns the drive levers 13 counter-clockwise, in the direction of arrow P, about a pivot pin 14 which is located at the upper end of the lever 13 (near grip 2). The counter-clockwise rotation of the drive levers 13 is partly transmitted to a below described ink mechanism 23 of the ink supply device A and to the lavel feeding mechanism 9 through first actuating levers 16, which are fixed to the driver levers 13 by means of the pins 14 and 15, and which are connected to the printing head 8 through connecting levers 17 and second actuating levers 18. The upper ends of links 18 are pivotally attached at pin 18*a* so as to pivot with respect to the frames 1 to which the pin 18*a* is attached.

The printing head 8 is equipped at its lower end with types 19 which can print the continuous label strip 5 which is fed onto a printing platen 7.

The ink supply device A includes an ink roller holding mechanism 20 for holding ink rollers 21 and 22 in a rotatable manner, a link mechanism 23 for moving the holding mechanism 20, and a guide mechanism 24 for ensuring that the ink rollers 21 and 22 can rotate over the surfaces of the types 19 while applying a preset constant pressure thereto.

Figure 5:
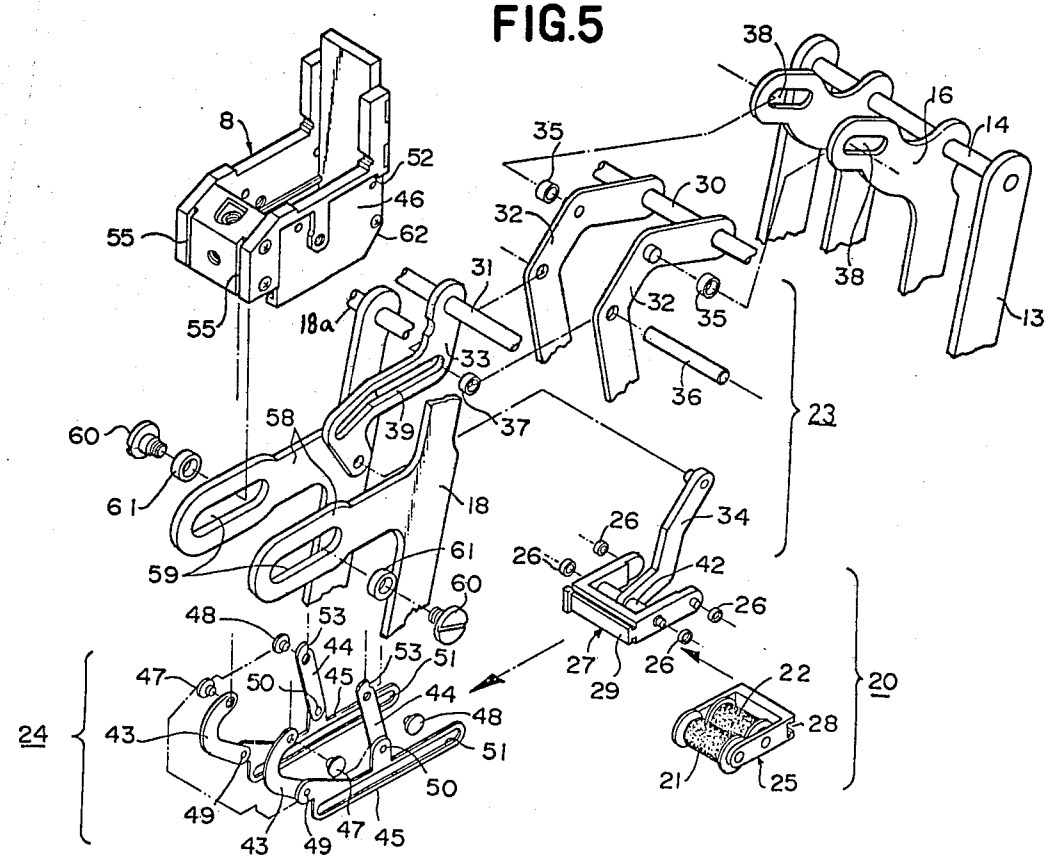
FIG. 5 is an exploded perspective view showing the major components of the ink supply device of the invention.

Referring to FIG. 5, the ink supply device A is now described. The ink roller holding mechanism 20 includes a generally C-shaped ink roller holder 25, and both legs of the holder have the ink rollers 21 and 22 rotatably mounted thereon. There is a generally C-shaped holder carriage 27, having two pairs of guide rollers 26 rotatably mounted at both sides thereof. The ink roller holder 25 is removably attached to the front (left end) of the carriage 27 by transversely sliding the correspondingly T-shaped groove and tenon 28 and 29, which are, respectively, formed on the outer surfaces of the bridge portions of the ink roller holder 25 and the carriage 27.

Figure 2:
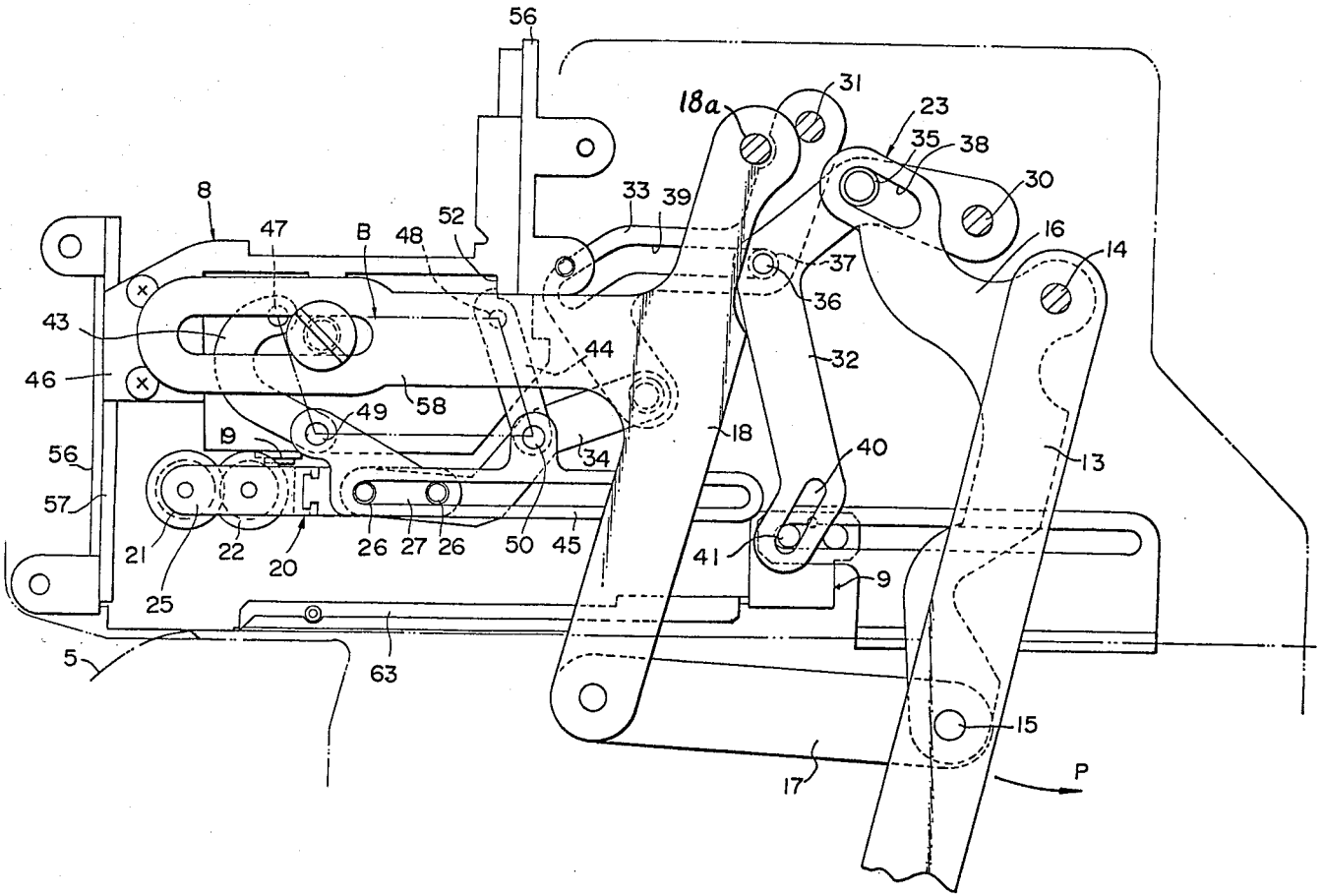
FIG. 2 is an enlarged side elevational view showing major elements of the ink supply device before operation of the device.

The link mechanism 23 includes a pair of first rotatable links 32, which are pivotally attached at their upper rear ends to pin 30 which extend horizontally between the machine frames 1. A pair of rollers 35 are rotatably attached to the respective outer sides of the upper bent portions of the first rotating links 32. The upper rollers 35 are fitted in the slots 38, which are formed in the forward ends of the first actuating lever 16. As seen in FIG. 2, the first rotating links 32 are formed at their lower end portions with slots 40. The pin 41 of the label feeding mechanism 9 extends through the slots 40.

A second rotating link 33 has an upper rear end that is pivotally connected to the pin 31. The pin 31 also extends between the frames 1. A horizontally extending pin 36 is arranged between the lower bent portions of the rotating links 32. A roller 37 is rotatably mounted on the center portion of the pin 36. Link 33 includes the slot 39 for guiding the rollers 37. The lower roller 37 is fitted in the slot 39 which is formed in the second rotating link 33.

There is a tracting or drawing link 34 for tracting or drawing or pulling the ink roller holding mechanism 20. The lower end portion of link 34 is pivotally connected to the pin 42, which extends between the leg portions of the holder carriage 27. The rotating link 33 has a lower end portion that is pivotally connected to the upper end portion of the tracting link 34.

The guide mechanism 24 includes a pair of front rocking links 43, a pair of rear rocking links 44 and a pair of guide links 45. The upper portions of the links 43, 44 at their upper ends are pivotally connected to both outer sides of the frame 46 of the printing head 8 by means of cap pins 47 and 48, respectively. The lower portions of the links 43, 44, at their lower ends are pivotally connected to the corresponding guide links 45 by pivot pins 49 and 50. As seen in FIG. 2, the pins 47, 48, 49 and 50 define the apexes of a parallelogram B.

The guide links 45 include horizontally extending guide slots 51, in which the guide rollers 26 are rotatably fitted. The guide rollers 26 are attached to the holder carriage 27 of the ink roller holding mechanism 20.

The rear rocking links 44 include notches 53 at their upper ends and facing rearwardly and which can be retained against the retaining step portions 52 on both sides of the head frame 46.

The printing head frame 46 includes four vertical grooves 55 for receiving corresponding guide projections 57 which are formed in the opposed surfaces of the paired support plates 56 which are fixedly attached between the machine frames 1.

The second actuating levers 18 include the horizontally forwardly extending lifting branches 58 which include slots 59 at their forward ends. A pair of rollers 61 are rotatably received in the slots 59 and are attached to the sides of the head frame 46 by cap screws 60. As a result, when the lifting branches 58 are moved up and down by the actions of the second actuating levers 18, the rollers 61 are so pushed that the printing head 8 can be moved up and down while being guided by the sliding movements of the guide projections 57 of the support plates 56 in the vertical grooves 55 of the head frame 46.

The operation of the ink supply device according to the present invention is now described. FIGS. 1 and 2 show the label printing machine in its inoperative condition. The lifting branches 58 of the second actuating levers 18 are horizontal and the printing head 8 is in its upraised position. Since the link mechanism 23 is inoperative, the ink roller holding mechanism 20 is in its leftward position. As a result, the ink rollers 21 and 22 are located to the left side of the types 19 of the printing head 8 so that the types are out of contact with the printing heads.

Figure 3:
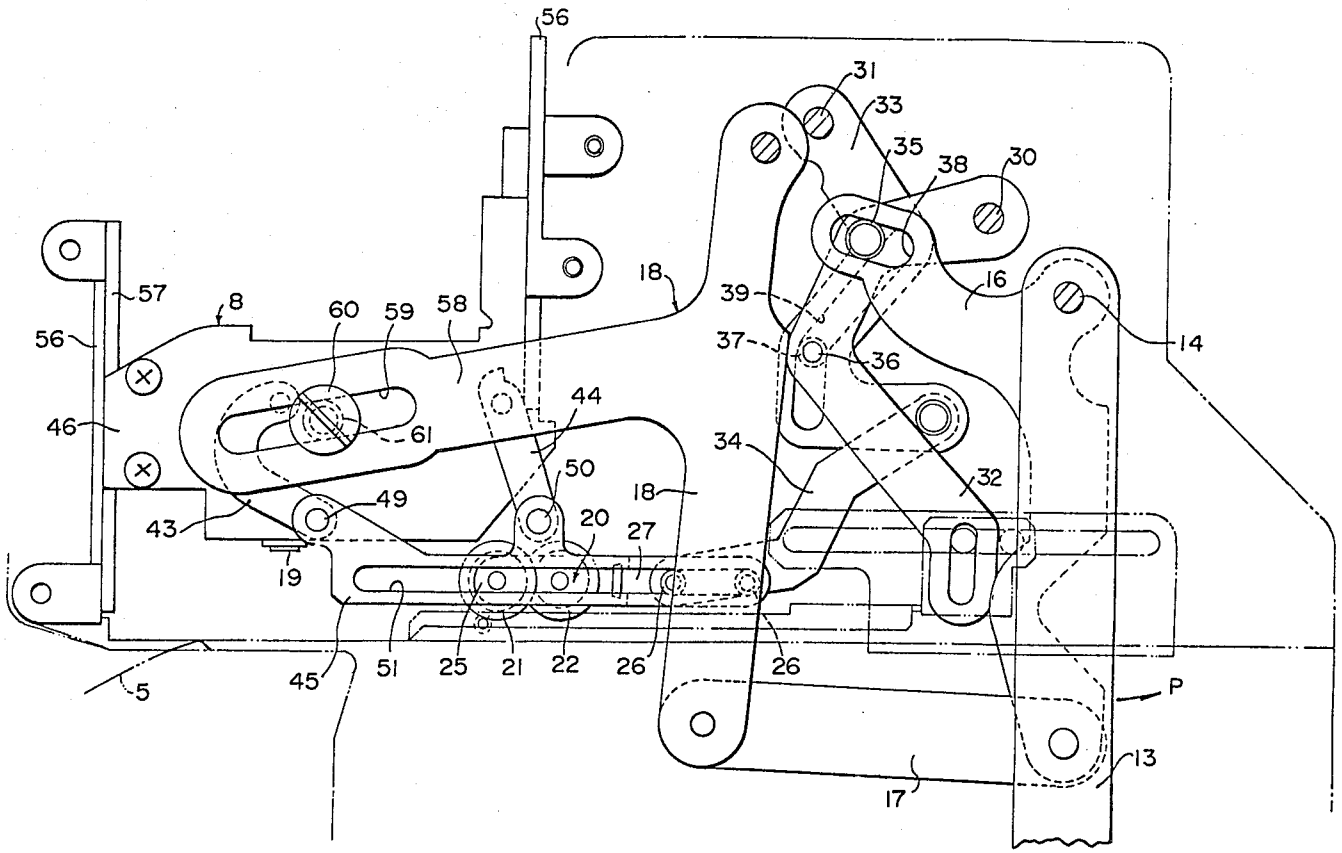
FIG. 3 is a view similar to FIG. 2, but showing the condition under which the ink supply device has partially operated.

When a start button (not shown) is depressed, the drive motor 12 operates to turn the drive levers 13 counter-clockwise in the direction of the arrow P, about the pin 14 at the upper end. During the rotating of the drive levers 13, both the first actuating levers 16, which are fixed thereto through the pins 14 and 15, and the second actuating levers 18, which are connected thereto through the connecting levers 17, are also turned counter-clockwise, as seen in FIG. 3. Upon rotation of the first actuating levers 16, the rollers 35 received in the slots 38 of the levers 16 are moved down. This causes the first rotating links 32 carrying the rollers 35 to also turn counter-clockwise about the pin 30 together with the pin 36 and its roller 37. As a result, the roller 37 turns in the slot 39 causing the second rotating link 33 to also turn counter-clockwise about the pin 31. Since the tracting link 34 is pivotally connected to the lower end portions of the second rotating link 33 and the ink roller holding mechanism 20 is attached to the link 34 by means of the pin 42, the tracting link 34, the holder carriage 27 and the ink roller holder 25 are all moved to the right or rearwardly by the rotation of the second rotating link 33.

The rotation of the second actuating levers 18 causes the forward ends of the lifting branches 58 to incline downwardly from their horizontal positions, as seen in FIG. 3. Meanwhile, the rollers 61 received in the slots 59 are moved forward through the slots while being carried downward with them. As a result, the printing head 8 is moved vertically downward along the guide projections 57 of the support plates 56. At the same time, the front and rear rocking links 43 and 44, which are pivotally connected to the head frame 46, and the guide links 45, which are pivotally connected to the lower ends of those links 43 and 44, are moved downward, in their same horizontal orientation together with the head frame 46.

The guide rollers 26, which are attached to the holder carriage 27, are rotatably fitted in the guide slots 51 of the guide links 45. Thus, the holder carriage 27, which is being moved to the right by the tracting action of the tracting link 34, is moved along a preset locus at all times because their guide rollers 26 are rolling through the guide slots 51. As a result, the ink rollers 21 and 22 in their holder 25, which holder is removably attached to the holder carriage 27, can turn always under a preset constant pressure upon the surfaces of the types 19 at the lower end of the printing head 8 for applying a preset constant amount of ink.

Figure 4:
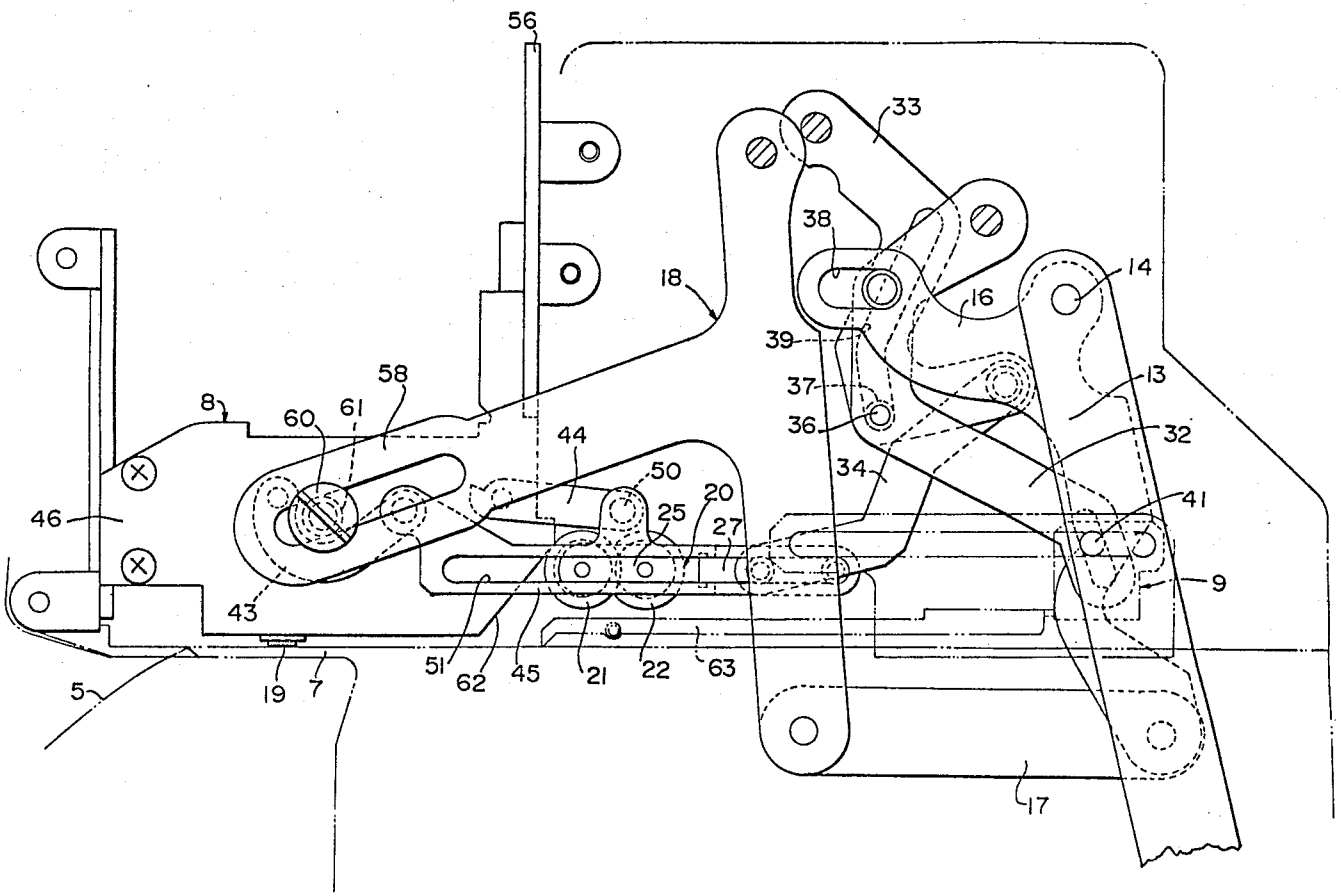
FIG. 4 is a view similar to FIGS. 2 and 3, but showing the condition under which the printing head is lowered to print a label.

As the counter-clockwise rotation of the drive levers 13 proceeds further, the first and second actuating levers 16 and 18 and, accordingly, the first and second rotating links 32 and 33 further rotate counter-clockwise, as seen in FIG. 4. As a result, the tracting link 34, which is pivotally connected to the lower end of the second rotating link 33, is moved to the right, thereby to tract the ink roller holder 25 and its carriage 27 in the same direction.

When the levers are in the condition of FIG. 3, the right hand pair of the guide rollers 26, which are attached to the holder carriage 27, have already arrived at the right hand extremity of the guide slots 51 of the guide links 45. As a result, when the holder carriage 27 is further moved from the position of FIG. 3 to that of FIG. 4, the guide links 45 engaged by the rollers 26 are also moved to the right by the right hand pair of the guide rollers 26.

The downward rotation of the lifting branches 58 of the second actuating levers 18 pushes the printing head 8 downward to its lower limit until it brings the type surfaces 19 into abutment contact with the continuous label strip 5 for accomplishing the label printing. Since, in this instance, the guide links 45 are being pulled to the right, the front and rear rocking links 43 and 44, which are pivotally connected at their lower ends to the guide links 45, are turned counter-clockwise, as viewed in FIG. 4, while they move downward together with the head frame 46. This permits the ink rollers 21 and 22 to move from below the printing head 8 to the right thereof along the upwardly inclined surface 62 of the head frame 46.

Since the pin 41 is moved to the right by the first rotating links 32, the label strip advancing pawls 63 of the label feeding mechanism 9 are moved together so that with the pin 41, the pawls wil also move out from below the printing head 8.

When printing of the continuous label strip 5 is finished, the drive levers 13 are turned in the opposite (or clockwise) direction, so that the first and second actuating levers 16 and 18 and accordingly the first and second rotating links 32 and 33 are also turned in the same (or clockwise) direction. This raises the printing head 8. The ink roller holding mechanism 20 and the advancing pawls 63 are moved to the left until they return through their condition of FIG. 3 to their condition of FIG. 2. Meanwhile, the label strip advancing pawls 63 advance the continuous label strip to the left by the length of one label so that the printed portion of the label strip 5 may be delivered to the front of the body of the label printing machine.

In a label printing machine according to the preferred embodiment, the operations thus far described are cyclically repeated a preset number of times so that a corresponding number of printed labels may be obtained.

The ink supply device to be used with the above described label printing machine differs from a conventional ink supply, in which the ink rollers are biased against the type sufaces by the biasing force of the spring. The ink supply device of the present invention comprises the ink rollers 21 and 22 that turn over the type surfaces 19 while the guide rollers 26 of the holder carriage 27 are being guided in the guide slots 51 of the guide links 45. The ink rollers 21 and 22 apply ink at a preset, constant pressure upon the type surfaces and do not approach nor leave the type surfaces to an excessive extent. Thus, the quantity of ink to be applied to the type surfaces can always be kept at a constant level, which ensures the desired clear and precise printing of labels or tags.

Furthermore, the ink rollers 21 and 22, which are made of a spongy material, can be deeply depressed, while they are turning, by the type surfaces 19. As the depressed surfaces of the ink rollers restore themselves to their original condition, the restoration produces a pumping action. Therefore, not only is the ink at the roller surfaces applied to the printing types, but also the ink stored deep in the center portions of the ink rollers 21 and 22 will be pumped to automatically ooze to the ink roller surfaces, so that the ink can be applied to the type surfaces in sufficient quantity and uniformly. As a result, an increased number of labels can be printed using one ink impregnated roller, in comparison with a conventional inking system.

Also, the ink supply device of the present invention is constructed so that the ink rollers are caused to roll back and forth through the body of the label printing machine so as to apply ink to the type surfaces. Furthermore, this inking mechanism eliminates the sideways protrusions or bulges of the labeler body, which are common to the prior art systems. Still further, the printing and/or applying operations of the labels can be so smooth as to remarkably improve the working efficiency and the overall design of the label printing machine.

The ink supply device according to the present invention can be used with both the desk type label printing machine described above, and also with a label printing machine or tagging machine of the portable type.

With these matters in mind, the present invention can find suitable application in a label printing machine, in which information, such as the bar codes, or codes to be read by optical readers, or OCR characters requiring especially high precision, can be printed upon tags or labels.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A label printing machine, including:

a frame; a platen supported by said frame;

a printing head, including type surfaces opposable to said platen; means for moving said printing head toward said platen for engaging said type surfaces against a label on said platen and for moving said printing head away from said platen;

an ink supply device for inking said type surfaces; said ink supply device comprising an ink roller for being rolled over said type surfaces; an ink roller holding mechanism for holding said ink roller to rotate as said ink roller moves over said type surfaces;

said means for moving being further connected with said ink roller holding mechanism for moving said holding mechanism back and forth through said frame and across said type surfaces as said printing head moves toward and away from said platen;

guiding means for guiding said holding mechanism for moving said ink roller over said type surfaces with a predetermined pressure against said type surfaces as said guide mechanism also moves with said printing head; said guiding means including a guide element attached to said holding mechanism;

a guide link rockably attached to said printing head and including a guide path means for being engaged by said guide element; said guide path means being shaped and oriented for guiding said guide element and said holding mechanism attached thereto across said type surfaces and for regulating the spacing between the axis of said ink roller and said type surfaces as said guide path means is engaged by said guide element;

said guide means further comprising a first and a second spaced apart rocking link; both said rocking links having one portion pivotally attached to said printing head, and said pivotal attachments being arrayed along the direction of motion of said ink roller across said printing head types; both said rocking links having another portion pivotally attached to said guide link.

2. The label printing machine of claim 1, wherein said guide element comprises a guide roller rotatably attached to said holding mechanism for rotating as said guide element moves along said guide path means.

3. The label printing machine of either of claims 1 or 2, wherein said guide path means comprises a guide slot in said guide mechanism for receiving said guide roller.

4. The label printing machine of claim 1, wherein said pivotal attachments at said one and said other portions of said rocking links are placed to define a parallelogram with one said rocking link, said guide link and the other said rocking link.

5. The label printing machine of claim 4, wherein said means for moving comprises:

a first rotatable link for being driven by a drive means and being pivotally connected to said frame;

a second rotatable link, also pivotally connected to said frame and being pivotally connected to said first rotatable link for being driven thereby;

a tracting and drawing link connected between said holding mechanism and said second rotatable link, such that rotation of said second rotatable link moves said tracting and drawing link back and forth along said frame, which thereby moves said roller over said types;

a third rotatable link, also pivotally connected to said frame, and being pivotally connected to said first rotatable link for being driven thereby; said third rotatable link being connected to said printing head for causing said printing head to move toward and away from said platen, as said third rotatable link rotates; said second rotatable, said tracting and drawing, and said third rotatable links being arranged so that after motion of said ink roller past said types in one direction, said printing head is caused to descend to said platen.

6. A label printing machine, including:

a frame; a platen supported by said frame;

a printing head, including type surfaces opposable to said platen; means for moving said printing head toward said platen for engaging said type surfaces against a label on said platen and for moving said printing head away from said platen; said means for moving comprising:

a first rotatable link for being driven by a drive means and being pivotally connected to said frame;

a second rotatable link, also pivotally connected to said frame and being pivotally connected to said first rotatable link for being driven thereby;

an ink supply device for inking said type surfaces; said ink supply device comprising an ink roller for being rolled over said type surfaces; an ink roller holding mechanism for holding said ink roller to rotate as said ink roller moves over said type surfaces;

said means for moving further comprising:

a tracting and drawing link connected between said holding mechanism and said second rotatable link, such that rotation of said second rotatable link moves said tracting and drawing link back and forth along said frame for moving said holding mechanism back and forth through said frame and across said type surfaces as said printing head moves toward and away from said platen, which thereby moves said ink roller over said types;

a third rotatable link, also pivotally connected to said frame, and being pivotally connected to said first rotatable link for being driven thereby; said third rotatable link being connected to said printing head for causing said printing head to move toward and away from said platen, as said third rotatable link rotates; said second rotatable, said tracting and drawing and said third rotatable links being arranged so that after motion of said ink roller past said types in one direction, said printing head is caused to descend to said platen;

a guide mechanism rockably attached to said printing head; said guide mechanism including guiding means for guiding said holding mechanism for moving said ink roller over said type surfaces with a predetermined pressure againt said type surfaces as said guide mechanism also moves with said printing head.

* * * * *